US007119036B2

(12) United States Patent
Maini

(10) Patent No.: US 7,119,036 B2
(45) Date of Patent: Oct. 10, 2006

(54) PROTECTIVE APPAREL FABRIC AND GARMENT

(75) Inventor: Surinder M Maini, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 35 days.

(21) Appl. No.: 09/780,632

(22) Filed: Feb. 9, 2001

(65) Prior Publication Data

US 2002/0155773 A1 Oct. 24, 2002

(51) Int. Cl.
*D03D 15/00* (2006.01)
*D03D 25/00* (2006.01)

(52) U.S. Cl. ..... 442/197; 57/210; 57/243; 428/364; 428/365; 442/181; 442/189; 442/301; 442/302

(58) Field of Classification Search ..... 57/244, 57/210, 243; 428/920–921, 364, 365; 442/181, 442/189, 197, 301–302
See application file for complete search history.

(56) References Cited

U.S. PATENT DOCUMENTS

| | | | | |
|---|---|---|---|---|
| 4,120,914 | A | 10/1978 | Behnke et al. | |
| 4,198,494 | A | 4/1980 | Burckel | |
| 5,185,195 | A * | 2/1993 | Harpell et al. | 428/102 |
| 5,299,602 | A | 4/1994 | Barbeau et al. | |
| 5,305,593 | A | 4/1994 | Rodini et al. | |
| 5,336,734 | A | 8/1994 | Bowen et al. | |
| 5,356,666 | A | 10/1994 | Jackson, Jr. et al. | |
| 5,389,326 | A | 2/1995 | Kasowski et al. | |
| 5,397,627 | A * | 3/1995 | Dunbar et al. | 442/189 |
| 5,399,418 | A * | 3/1995 | Hartmanns et al. | 428/218 |
| 5,468,537 | A | 11/1995 | Brown et al. | |
| 5,688,594 | A | 11/1997 | Lichscheidt et al. | |
| 5,856,005 | A | 1/1999 | Gurian | |
| 5,879,800 | A * | 3/1999 | Geirhos | 428/370 |
| 6,049,906 | A | 4/2000 | Aldridge | |
| 6,349,531 | B1 * | 2/2002 | Kolmes et al. | 57/229 |

FOREIGN PATENT DOCUMENTS

| | | |
|---|---|---|
| DE | 19506316 | 11/1997 |
| EP | 0533931 | 3/1993 |
| EP | 0913170 | 5/1999 |

* cited by examiner

*Primary Examiner*—Terrel Morris
*Assistant Examiner*—Jennifer Boyd

(57) ABSTRACT

A fabric for flame resistance apparel with a limiting oxygen index greater than 21 employs a yarn of a co-mingled bundle of two different filaments of different shrinkage characteristics with the yarn having a random entangled loop structure.

9 Claims, No Drawings

PROTECTIVE APPAREL FABRIC AND GARMENT

BACKGROUND OF THE INVENTION

One common problem with the flame-resistant protective apparel worn by firemen and others is that the fabrics used are typically quite heavy to provide needed thermal protection to the wearer. Any improvement in weight savings with equivalent performance is welcomed because lighter fabrics put less stress on the person wearing the protective apparel. This invention is directed to a fabric having improved thermal properties, and comfort for use in protective apparel, and a garment containing that fabric. Also in certain instances durability of the fabric is improved.

SUMMARY OF THE INVENTION

This invention provides a woven fabric having a limiting oxygen index (LOI) of greater than 21, preferably greater than 26 and made using a yarn which is comprised of a co-mingled bundle of 10 to 90 wt % of a first continuous filament component and 90 to 10 wt % of a second continuous filament component, the two continuous filament components having different shrinkage characteristics when exposed to an elevated temperature such as from a flame. The yarn further has a random entangled loop structure wherein the weight per unit length of the yarn is 3 to 25 percent higher, preferably 10 to 18 wt % higher, than a continuous filament yarn having the same composition but no entanglement or loops. A preferred woven fabric contains continuous filament yarns, which are comprised of a co-mingled bundle of 10 to 90 wt % para-aramid filaments and 90 to 10 wt % meta-aramid filaments.

The woven fabric of the present invention provides improved resistance to elevated temperature such as from a flame compared to a fabric using the same filaments but without entanglements or loops. Filaments may be used in the present invention of a thinner diameter resulting in a weight savings in the final fabric. This weight saving is sufficient in overcoming an added weight in the present invention due to an additional amount of filament needed per unit area due to the entanglements or loops.

This invention also provides for a protective garment such as firefighter's turnout gear, having the fabric of this invention as the outer shell. Such garments are typically comprised of an outer shell, a moisture barrier, and an inner liner. In a preferred embodiment, the outer shell fabric is comprised of aramid continuous filament yarns.

Yarns have a linear density of 200 to 1000 denier (220 to 1100 dtex), preferably 300 to 600 denier (340 to 680 dtex) can be used in the invention. The woven fabrics can use a plain or twill weave and can be made from aramid filament components or any other filament components which result in a fabric having an LOI of greater than 21. In a preferred embodiment, the continuous aramid filament components are poly(paraphenylene terephthalamide) filaments and poly (metaphenylene isophthalamide) filaments.

DETAILED DESCRIPTION OF THE INVENTION

The heavy coats used by firemen are known as turnout coats and a typical construction of such coats involves an outer flame-resistant shell fabric, an inner thermal quilting or liner, and a moisture barrier sandwiched between these two to keep the inner thermal liner and the fireman dry. The outer flame-resistant layer can be as much as 40% or more of the weight of the garment, because this layer must be durable and flame-resistant. Typically, these fabrics are woven and are made using staple yarns.

The woven fabrics of this invention use continuous filament yarns and have equivalent flame performance to the prior art fabrics made with staple yarns while being of substantially lighter weight than those fabrics. The yarn used in these woven fabrics is bulked to co-mingle the filaments and create a random entangled loop structure in the yarn. One process which accomplishes this is called air-jet texturing wherein pressurized air, or some other fluid, is used to rearrange the filament bundle and create loops and bows along the length of the yarn. In a typical process, the multi-filament yarn to be bulked is fed to a texturing nozzle at a greater rate than it is removed from the nozzle. The pressurized air impacts the filament bundle, creating loops and entangling the filaments in a random manner. For the purposes of this invention, it is desirable to have an overfeed rate of 14 to 25% with a usable range in the order of 5 to 30%. Using a bulking process with this overfeed rate creates a co-mingled yarn having a higher weight per unit length, or denier, than the yarn that was fed to the texturing nozzle. It has been found that the increase in weight per unit length should be in the range of 3 to 25 wt %, with increases in the 10–18 wt % preferred. It has been found that the bulked yarn that is most useful in the making of the fabric in this invention is preferably in the range of 200 to 1000 denier, and more preferably 300 to 600 denier.

The loops and entanglements create a continuous filament yarn which has some surface characteristics similar to a spun staple yarn. It is thought that some of the improvement in flame performance of fabrics made from such yarns is due to the tiny pockets of air created in the randomly entangled yarn. These pockets are thought to help provide insulating value to the fabric.

The yarn used in these woven fabrics is made using two different continuous filament components. The two different continuous filament components should shrink differently when exposed to a heat. Without being based to any theory, it is believed when the woven fabric is exposed to a flame a differential shrinkage creates localized air pockets which contribute to an improved insulating effect. It is considered that air pockets are formed between the woven fabric and the next layer, which could be moisture barrier in case of turnout gear or undergarments or skin in the case of single layer garments. In a preferred embodiment, the two different continuous filament components are present in the yarn in equal amounts (50%/50%) by weight. This should provide for maximum localized shrinkage difference in the fabric and air pocket generation. However, valuable fabrics can be made at various combinations, including blends such as by weight 33% of one type of fiber and 67% of another. The co-mingled bundle of fiber must have at least two different continuous filament components, and one of those components preferably is present in an amount of at least 10% by weight difference for the differential shrinkage to be effective.

The woven fabrics of this invention have a Limiting Oxygen Index greater than 21. Limiting Oxygen Index (LOI) is a measure of the flammability of a substance. The test for LOI determines the minimum percentage of oxygen needed in the atmosphere to sustain burning of a material. Materials having a LOI of greater than 21 will not sustain burning of a material in air at atmospheric pressure. The higher the LOI, the less flammable the tested material is.

U.S. Pat. No. 5,356,666 discloses several yarns useful in creating this woven fabric having a high LOI; aramid fibers have LOIs in the range of 27–28 and are particularly useful in this invention. Fibers can have imbibed or spun in additives which increase the LOI of fabrics made from those fibers. While not intended to be limiting, specific fibers useful in this invention include poly(paraphenylene terephthalamide, poly (metaphenylene isophthalamide), and polybenzimidazoles.

Further disclosures of useful yarns include U.S. Pat. No. 5,299,602, Barbeau, et al.; U.S. Pat. No. 4,120,914, Behnke; U.S. Pat. No. 4,198,494, Burckel; U.S. Pat. No. 5,305,593, Rodini, et al.; U.S. Pat. No. 5,389,326, Kasowski, et al.; U. S. Pat. No. 5,336,734, Bowen, et al.; and U.S. Pat. No. 5,468,537, Brown, et al.

The fabric when used as the outer shell of a protective garment can be woven using a plain or twill weave. Prior art fabrics made from ring spun staple yarns, when used as these outer shell fabrics, required a rip stop construction to meet the National Fire Protection Association (NFPA) trap tear requirement. Rip stop fabrics have at least one reinforcing yarn inserted in both warp and fill directions at regular intervals in addition to the regular warp and fill yarns; these additional reinforcing yarns help prevent rips or tears from spreading or propagating through a fabric. The fabrics of this invention, however, require no such additional reinforcing yarns to meet the tear requirement, and are as much as three times the trap tear of the rip stop fabrics. Further, because there is no need for the rip-stop construction, the fabrics of this invention can have a smoother surface than the prior art outer shell fabrics. This translates to less abrasion of the outer shell and a more durable garment.

As stated before, a typical construction for firefighters' protective garments (coats and pants) combines an outer flame-resistant shell fabric, an inner thermal quilting or liner, and a moisture barrier sandwiched between these two to keep the inner thermal liner dry.

The outer shell fabric of the present invention has a weight in the range of 4 to 8 oz./sq. yd., preferably 4 to 6 oz./sq. yd. A tight weave is preferred. It is preferred in the garments of this invention that at least 50%, and preferably the entire shell fabric be composed of the fabrics comprised of the bulked filament yarns having a differential shrinkage.

The purpose of the inner thermal liner is to reduce heat flow to the wearer of the garment and can be made from several layers of spunlaced or needlepunched nonwoven material. Two or three layers of spunlaced aramid nonwoven material is especially preferred. This nonwoven material is typically quilted with a face cloth of a flame resistant fabric. This face cloth forms the innermost layer of the garment. The total weight of this quilted inner liner with facecloth is typically in the 5 to 10 oz./sq. yd. range.

Positioned between the outer shell and the inner liner is a moisture barrier layer. The function of the moisture barrier is to provide waterproofness while permitting transfer of water vapor. A commonly used moisture barrier layer is comprised of light-weight breathable membrane such as the poly(tetrafluoroethylene) membranes supplied by W. L. Gore and Associates and known as GORETEX®. It is normally laminated to a support fabric such as a lightweight spunlaced aramid nonwoven of poly(paraphenylene terephthalamide) filaments and poly(metaphenylene isophthalamide) fiber having a basis weight of 2.5 to 3.5 oz./sq.yd. The total weight of the moisture barrier layer of the garment is commonly in the range of 3 to 4 oz./sq. yd.

Test Methods

LOI is measured using ASTM D2863-91. Trap tear and TPP (Thermal Protective Performance) were measured using NFPA 1971.

Fabrics were dyed at 130° C. for 60 minutes in a dye bath containing cationic dyes, 40 g/l Cindye C45 dye carrier, and 20 g/l sodium nitrate to assist the transfer of dye to the fabric. Cindye C45 is available from Stockhausen, Inc., 2408 Doyle Street, Greensboro, N.C.

EXAMPLE 1

This example illustrates the improved thermal performance of the fabrics of this invention. 200 denier continuous filament yarns of Nomex®, poly(metaphenylene isophthalamide), fiber and 200 denier continuous filament yarns of Kevlar®, poly(paraphenylene terephthalamide), fiber were combined side-by-side in a texturing jet and were air-jet textured together to produce an entangled, co-mingled yarn having 50% Nomex® filament and 50% Kevlar® filament and a final yarn denier of 440 which has 10% bulk compared to the starting yarn. This yarn was woven into both plain weave and 2/1 twill weave fabrics. The fabrics were dyed to a black color. TPP performance of these fabrics was compared to that of a fabric made with staple blend of Nomex® filaments and Kevlar® filaments and a fabric made from a combination of continuous filament yarns and staple yarns of Nomex® filaments and Kevlar® filaments (disclosed in U.S. Pat. No. 5,299,602). The fabrics of this invention were piece dyed as was one of the comparison fabrics; the other comparison fabric contained spun-in pigments. As shown in Table I, the fabrics of this invention gave better TPP performance per unit weight basis when compared to the other two fabrics.

TABLE I

| Fabric | A | B | C | D |
|---|---|---|---|---|
| Fibers | 50% Nomex ®/ 50% Kevlar ® | 50% Nomex ® 50% Kevlar ® | 50% Kevlar ®/ 50% Nomex ® | 50% Nomex ®/ 50% Kevlar |
| Yarn | Air Jet Textured | Air Jet Textured | Ring Spun | Continuous Filament & Air Jet Spun |
| Fabric Construction | Plain Weave | 2/1 Twill Weave | Rip Stop Plain Weave | 2/1 Twill Weave |
| Coloration Method | Piece Dyed | Piece Dyed | Pigmented | Piece Dyed |
| Fabric Weight (oz/yd$^2$) | 4.9 | 4.8 | 7.1 | 6.2 |
| L.O.I | 26.5 | 26.8 | — | — |
| TPP (cal/cm$^2$) | 12.7 | 14.4 | 14.4 | 10.8 |
| TPP/unit weight (cal/[cm$^2$ oz/yd$^2$]) | 2.6 | 3.0 | 2.0 | 1.7 |

EXAMPLE 2

This example shows the improved thermal performance of the composites made with the fabrics of this invention. Composite fabrics were made to simulate protective apparel with one layer of the Nomex®/Kevlar® fabric as the outer shell, 2 or 3 layers of DuPont's E89™ spunlaced aramid nonwoven quilted to a thin woven Nomex® facing fabric as an inner thermal liner, and a layer of Crosstech® moisture barrier placed between the thermal liner and the outer shell. Crosstech® moisture barrier consisted of polytetrafluoroethylene membrane laminated to spunlaced aramid. Comparison fabrics were made with the same thermal liner and moisture barrier but with outershell fabrics made of Kevlar®/Nomex® filaments and Kevlar®/polybenzemidazole intimately blended ring-spun staple yarns. All composite fabrics were tested for Thermal Protective Performance (TPP) with the outershell fabrics facing the flame. As shown in Table II, the fabrics of this invention gave better TPP performance with lower composite weights.

TABLE II

| Composite | E | F | G | H | I | J |
|---|---|---|---|---|---|---|
| Fibers | 50% Nomex ®/ 50% Kevlar ® | 50% Nomex ® 50% Kevlar ® | 50% Nomex ®/ 50% Kevlar ® | 50% Nomex ® 50% Kevlar ® | 60% Kevlar ®/ 40% Nomex ® | 60% Kevlar ®/ 40% PBI |
| Yarn | Air Jet Textured | Air Jet Textured | Air Jet Textured | Air Jet Textured | Ring Spun | Ring Spun |
| Fabric Construction | Plain Weave | 2/1 Twill Weave | Plain Weave | 2/1 Twill Weave | Rip Stop Plain Weave | Rip Stop Plain Weave |
| Fabric Weight (oz/yd$^2$) | 4.9 | 4.8 | 4.9 | 4.8 | 7.4 | 7.8 |
| Moisture Barrier Layers | 1 | 1 | 1 | 1 | 1 | 1 |
| Thermal Liner Layers | 2 | 2 | 3 | 3 | 2 | 2 |
| Composite Fabric Weight (oz/yd$^2$) | 15.2 | 15.0 | 16.8 | 16.1 | 17.5 | 17.8 |
| TPP (cal/cm$^2$) | 35.6 | 36.6 | 40.7 | 41.1 | 38.1 | 38.8 |

EXAMPLE 3

This example illustrates the improved thermal performance fabrics of this invention. 200 denier continuous filament yarns of Nomex® fiber and 200 denier continuous filament yarns of Kevlar® fiber were combined side-by-side in a texturing jet and were air-jet textured together to produce an entangled, co-mingled yarn having 50% Nomex® fiber and 50% Kevlar® fiber and a final yarn denier of 440 which has 10% bulk compared to the starting yarn. A staple blend of 50% Nomex® fiber and 50% Kevlar® fiber was used to make a ring spun yarn of 26's/2 cotton count. Plain weave and 2/1 twill weave fabrics were woven using ring spun yarns in the warp direction and air-jet textured yarns in the fill direction. The fabrics were dyed to a black color. TPP performance of these fabrics is compared to fabrics C and D of Example 1.

TABLE III

| Fabric | K | L | C | D |
|---|---|---|---|---|
| Fibers | 50% Nomex ®/ 50% Kevlar ® | 50% Nomex ® 50% Kevlar ® | 50% Kevlar ®/ 50% Nomex ® | 50% Kevlar ®/ 50% Nomex ® |
| Yarn | Ring Spun & Air Jet Textured | Ring Spun & Air Jet Textured | Ring Spun & Air Jet Spun | Continuous Filament |
| Fabric Construction | Plain Weave | 2/1 Twill Weave | Rip Stop Plain Weave | 2/1 Twill Weave |
| Coloration Method | Piece Dyed | Piece Dyed | Pigmented | Piece Dyed |
| Fabric Weight (oz/yd$^2$) | 5.4 | 5.4 | 7.1 | 6.2 |
| TPP (cal/cm$^2$) | 13.2 | 14.0 | 14.4 | 10.8 |
| TPP/unit weight (cal/[cm$^2$ oz/yd$^2$]) | 2.4 | 2.6 | 2.0 | 1.7 |

EXAMPLE 4

This example illustrates the improved thermal performance of the fabrics of this invention. 200 denier continuous filament yarns of Nomex® fiber and 200 denier continuous filament yarns of Kevlar® fiber were combined side-by-side in a texturing jet and were air-jet textured together to produce an entangled, co-mingled yarn having 50% Nomex® fiber and 50% Kevlar® fiber and a final yarn denier of 485 which has 16% bulk compared to the starting yarn. This yarn was woven into both plain weave and 2/1 twill weave fabrics. 100 denier continuous filament yarns of Nomex® fiber and 200 denier continuous filament yarns of Kevlar® fiber were combined side-by-side in a texturing jet and were air-jet textured together to produce an entangled, co-mingled yarn having 33% Nomex® fiber and 67% Kevlar® fiber and a final yarn denier of 355 which has 16% bulk compared to the starting yarn. This yarn was woven into both plain weave and 2/1 twill weave fabrics. The fabrics were dyed to a tan color. TPP performance of these fabrics is compared to fabrics C and D of Example 1. As shown in Table V, fabrics of this invention gave better TPP performance per unit weight basis when compared to the other two fabrics.

TABLE IV

| Fabric | M | N | O | P | C | D |
|---|---|---|---|---|---|---|
| Fibers | 50% Nomex ®/ 50% Kevlar ® | 50% Nomex ® 50% Kevlar ® | 67% Kevlar ®/ 33% Nomex ® | 67% Kevlar ®/ 33% Nomex ® | 50% Kevlar ®/ 50% Nomex ® | 50% Nomex ®/ 50% Kevlar |
| Yarn | Air Jet Textured | Air Jet Textured | Air Jet Textured | Air Jet Textured | Ring Spun & Air Jet Spun | Continuous Filament |
| Fabric Weave | Plain Weave | 2/1 Twill Weave | Plain Weave | 2/1 Twill Weave | Rip Stop Plain Weave | 2/1 Twill Weave |
| Coloration Method | Piece Dyed | Piece Dyed | Piece Dyed | Piece Dyed | Pigmented | Piece Dyed |
| Fabric Weight (oz/yd$^2$) | 6.1 | 6.2 | 4.9 | 5.1 | 7.1 | 6.2 |
| TPP (cal/cm$^2$) | 14.0 | 14.7 | 12.2 | 13.0 | 14.4 | 10.8 |
| TPP/unit weight (cal/[cm$^2$ oz/yd$^2$]) | 2.3 | 2.4 | 2.5 | 2.5 | 2.0 | 1.7 |

EXAMPLE 5

This example illustrates the improved tear performance of this invention. Fabrics made with ring spun yarns need to have rip stop constructions to meet the minimum National Fire Protection Association (NFPA) requirement of 22 lbs. of trap tear. The fabrics of this invention A & B were compared with 50/50 Nomex®/Kevlar® fabrics made from ring-spun staple yarns. The fabrics of this invention had significantly improved trap tear performance.

TABLE V

| Fabric | A | B | C |
|---|---|---|---|
| Fibers | 50% Nomex ®/ 50% Kevlar ® | 50% Nomex ® 50% Kevlar ® | 50% Nomex ® 50% Kevlar ® |
| Yarn | Air Jet Textured | Air Jet Textured | Ring Spun |
| Fabric Construction | Plain Weave | 2/1 Twill Weave | Rip Stop Plain Weave |
| Fabric Weight (oz./yd$^2$) | 4.9 | 4.8 | 7.1 |
| Trap Tear Warp × Fill (lbs.) | 47 × 63 | 68 × 81 | 35 × 27 |

What is claimed is:

1. A woven fabric comprised of continuous filament yarn, consisting of a co-mingled bundle of 10 to 90 wt % para-aramid filaments and 90 to 10 wt % meta-aramid filaments, said yarn having a random entangled loop structure wherein the weight per unit length of the yarns is 3 to 25 percent higher than a continuous filament yarn having the same composition but no entanglement or loops.

2. The woven fabric of claim 1 wherein the weight per unit length of the yarn is 10 to 18 wt % higher than a continuous filament yarn having no entanglement or loops.

3. The woven fabric of claim 1 wherein the yarn having a random entangled loop structure has a linear density of 200 to 1000 denier (220 to 1100 dtex).

4. The woven fabric of claim 3 wherein the yarn having a random entangled loop structure has a linear density of 300 to 600 denier (340 to 680 dtex).

5. The woven fabric of claim 1 made from a plain weave.

6. The woven fabric of claim 1 made from a twill weave.

7. The woven fabric of claim 1 wherein the para-aramid filaments are poly(paraphenylene terephthalamide) filaments.

8. The woven fabric of claim 1 wherein the meta-aramid filaments are poly(metaphenylene isophthalamide) filaments.

9. The woven fabric of claim 1 wherein the para-aramid filaments are poly(paraphenylene terephthalamide) filaments and are present in an amount of 50% and the meta-aramid filaments are poly(metaphenylene isophthalamide) filaments and are present in an amount of 50%.

* * * * *